US006325325B1

(12) United States Patent
Bonnet et al.

(10) Patent No.: US 6,325,325 B1
(45) Date of Patent: Dec. 4, 2001

(54) DEVICE FOR TRANSLATIONAL BRAKING OF A PROJECTILE ON ITS TRAJECTORY

(75) Inventors: Alain Bonnet, Bourges; Bertrand Padiolleau, Saint-Florent; Anne-Laure Cros, Bourges, all of (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/548,343

(22) Filed: Apr. 12, 2000

(30) Foreign Application Priority Data

Apr. 16, 1999 (FR) ..... 99 04861

(51) Int. Cl.[7] ..... F42B 10/00

(52) U.S. Cl. ..... 244/3.24; 244/113; 244/3.26; 244/3.29

(58) Field of Search ..... 244/113, 3.26, 244/3.29, 110 D, 3.1, 3.21, 3.24; 102/386, 529, 501

(56) References Cited

U.S. PATENT DOCUMENTS 2,840,326 * 6/1958 Richardson et al. .
3,188,958 * 6/1965 Burke et al. .
5,762,291 * 6/1998 Hollis et al. .
5,816,531 10/1998 Hollis et al. .
5,826,821 10/1998 Brandon et al. .

FOREIGN PATENT DOCUMENTS 21 04 914 A 8/1972 (DE) .
0 138 942 B1 5/1985 (EP) .
2 071 271 A 9/1971 (FR) .
WO 98/01719 1/1998 (WO) .

* cited by examiner

*Primary Examiner*—Charles T. Jordan
*Assistant Examiner*—Tian Dinh
(74) *Attorney, Agent, or Firm*—Oliff & Berridge, PLC

(57) ABSTRACT

A translational braking device for a projectile on its trajectory. The device has at least two air brakes made in the form of flaps that are moved in a plane perpendicular to the axis of the projectile to increase the aerodynamic drag of the projectile. Each flap has at least two closed grooves, extending essentially parallel to a direction that is perpendicular to the axis of the projectile, each groove cooperating with a rod that is fixed with respect to the projectile.

20 Claims, 5 Drawing Sheets

DEVICE FOR TRANSLATIONAL BRAKING OF A PROJECTILE ON ITS TRAJECTORY

BACKGROUND OF THE INVENTION

The invention relates to devices for translational braking of a projectile on its trajectory.

Such devices are known, particularly in the field of artillery. EP138942 describes an artillery projectile which comprises a device for braking a warhead whose deployment is controlled on the trajectory.

Such a device makes it possible to improve the accuracy of artillery firing, taking into account the scatter due to variations in the initial velocity of the projectile. It is thus possible to aim the weapon so as to fire further than the target in sight; a fire control measures the true velocity of the projectile at the muzzle of the weapon barrel and a braking order is then transmitted to the projectile in order to reduce its range and bring it to the desired impact point.

The braking device described by this patent comprises either radially mobile ratchets or a flat frontal surface. Compared to the projectile cross section, the surface of these braking means is too small to give them sufficient braking capacity.

Patent WO98/01719 describes another braking device for projectiles. The device comprises four air brake plates stacked on each other and mobile radially with respect to the projectile. The braking surface is thus greatly increased (it constitutes approximately double the projectile cross section) with a reduced bulk inside the projectile body. This device, however, entails drawbacks.

The shapes of the plates are complicated when it comes to machining them; they also involve numerous notches that reduce their mechanical strength, especially when they are in their totally deployed position, which is the position where the stresses are at a maximum. Moreover, each plate is guided by the cooperation of pins integral with the ends of arms on the plate and which cooperate in the notches of a neighboring plate as well as a base plate. The arms have some flexibility, which impairs the reliability of the guidance function. This entails the risk of jamming and this risk is further increased by the fact that there is double guidance (on a neighboring plate and on a base plate). Finally, the plates are unlocked by means of two gas generators that move two retaining pins with each pin immobilizing two plates. Such a structure is liable to cause dissymmetries or jamming at the moment the plates are deployed; this, in turn, entails the risk of altering the projectile trajectory in a nonreproducible fashion.

SUMMARY OF THE INVENTION

The object of the invention is to propose a translational braking device for a projectile that does not present these drawbacks.

The braking device according to the invention is based on a simple and low-cost design; it offers improved mechanical strength when compared to the previously described device. It has low susceptibility to jamming and this results in a perfect air brake opening symmetry.

The invention thus relates to a translational braking device for a projectile on its trajectory; it comprises at least two radially deployable air brakes so as to increase the aerodynamic drag of the projectile; the air brakes are made in the form of flaps that move in a plane perpendicular to the axis of the projectile; the device is characterized in that each flap has at least two closed grooves extending essentially parallel to a direction that is perpendicular to the axis of the projectile, each groove cooperating with a rod that is fixed with respect to the projectile. Each rod advantageously could cooperate with two grooves of two adjacent flaps. The device could comprise at least one pyrotechnic piston, providing for the locking of at least one of the flaps when in the folded position.

According to a particular embodiment, at least two of the flaps are stacked on each other when they are in their folded position with at least a first of the two flaps comprising means that keeps the second of the two flaps in the folded position.

According to another embodiment, the braking device comprises at least three flaps, a first flap being locked by the pyrotechnic piston and having a first notch, cooperating with a first pin borne by a second flap to keep the latter in the folded position, while the second flap bears a second notch, cooperating with a second pin borne by a third flap to keep the latter in the folded position with a single pyrotechnic piston, thus locking all of the three flaps. Each flap can have an external structural shape covering an arc of a circle whose diameter is essentially equal to the diameter of an external portion of the projectile, and a notch, designed to make it possible to place the flap in the folded position around an axial support integral with the projectile. The axial support could bear two plates, one lower plate and one upper plate, connected by the rods, while the flaps are disposed between the two plates when they are in the folded position.

According to another particular embodiment, at least one groove in each flap could have means for slowing down the deployment movement of the flap. Means for slowing down the deployment movement could advantageously comprise a particular shape of the groove and/or a particular shape of the notch with the groove and/or the notch having at least one indentation. The flaps could also be generally integral with a nose fuze of the projectile.

BRIEF DESCRIPTION OF THE DRAWINGS

Other advantages of the invention will appear on reading the description below with reference to several embodiments; the description is provided with reference to the attached drawings, where:

FIGS. 5*a*, 5*c* and 5*e* are frontal views of the flaps and FIGS. 5*b*, 5*d* and 5*f* are lateral views of the various flaps, each of the frontal views being associated with its lateral view for a specific flap (5*a*/5*b*, 5*c*/5*d* and 5*e*/5*f*); FIG. 5*b* is a cross section of FIG. 5*a* along a plane 55 in FIG. 5*a*.

DETAILED DESCRIPTION OF PREFERRED EMBODIMENTS

Figure 1:
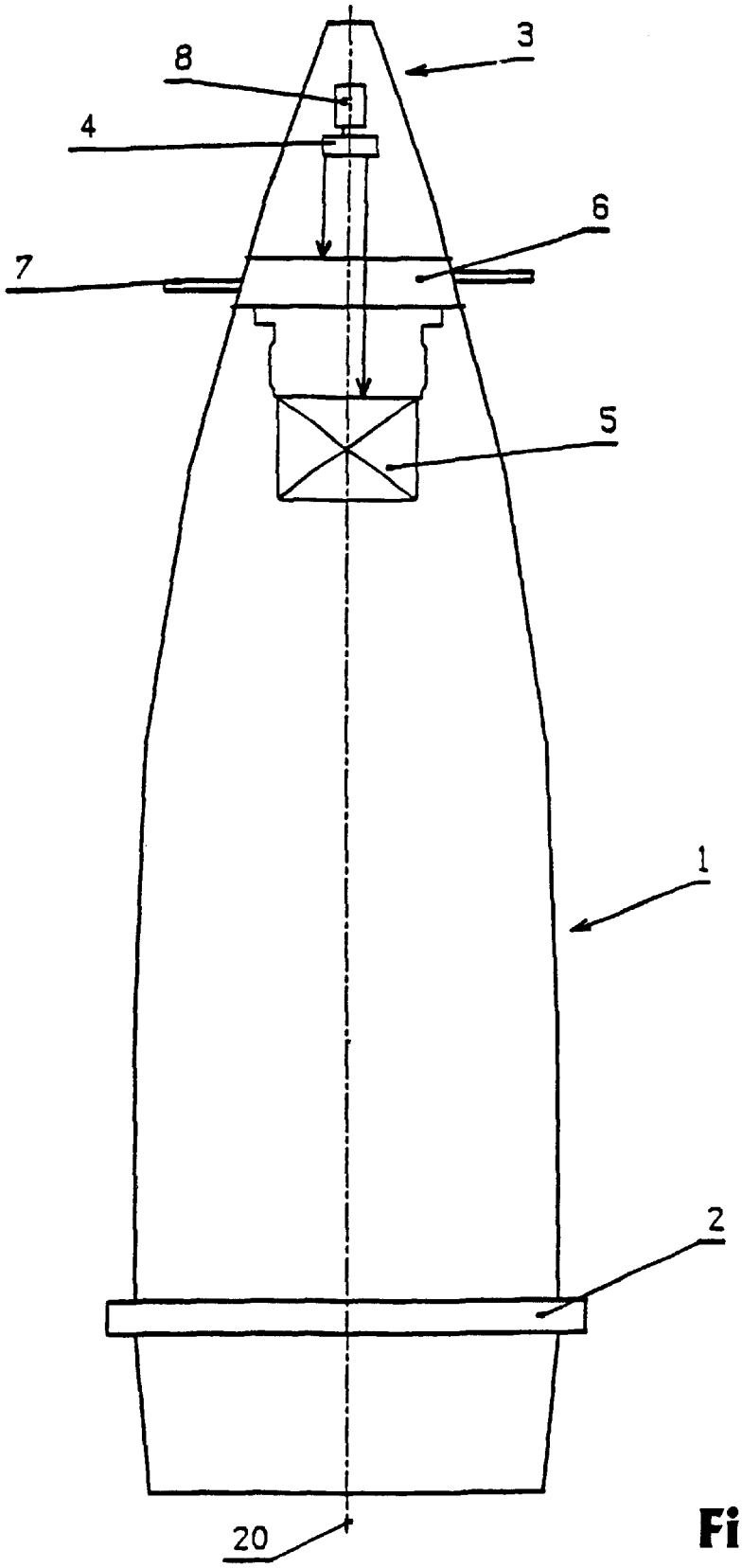
FIG. 1 is a diagram of a projectile equipped with a braking device according to the invention.

Referring now to FIG. 1, an artillery projectile 1, having a central axis 20, is provided at the level of its rear portion with a band 2 designed to engage the rifling of a weapon barrel (not shown) and to provide a seal against the propellant gases as the projectile is fired. In its forward part, the projectile has a fuze 3, which is designed in the conventional way and in accordance with the type of projectile considered (explosive projectile or payload projectile); it is designed to ensure either the initiation of an explosive charge placed inside the projectile or the ignition of a gas-generating charge designed to eject on the trajectory a payload placed inside the projectile (antitank submunitions or grenades).

For this purpose, the fuze has an electronic control device 4 that triggers a pyrotechnic charge 5 (which, depending on the case, is a detonation relay or a gas generator).

According to the invention, the fuze 3 also includes a translational braking device 6, for radial deployment of braking flaps 7 on the trajectory. The deployment of flaps 7 is controlled by the electronic control device 4 in response to an order received during the flight trajectory through a receiver 8 or produced by electronic control device 4 according to firing pre-programming, or it is modified during the first moments following firing to allow for the true initial velocity of the projectile.

Programming for the trajectory is accomplished by receiver 8 that could involve radar technology.

Figure 2:
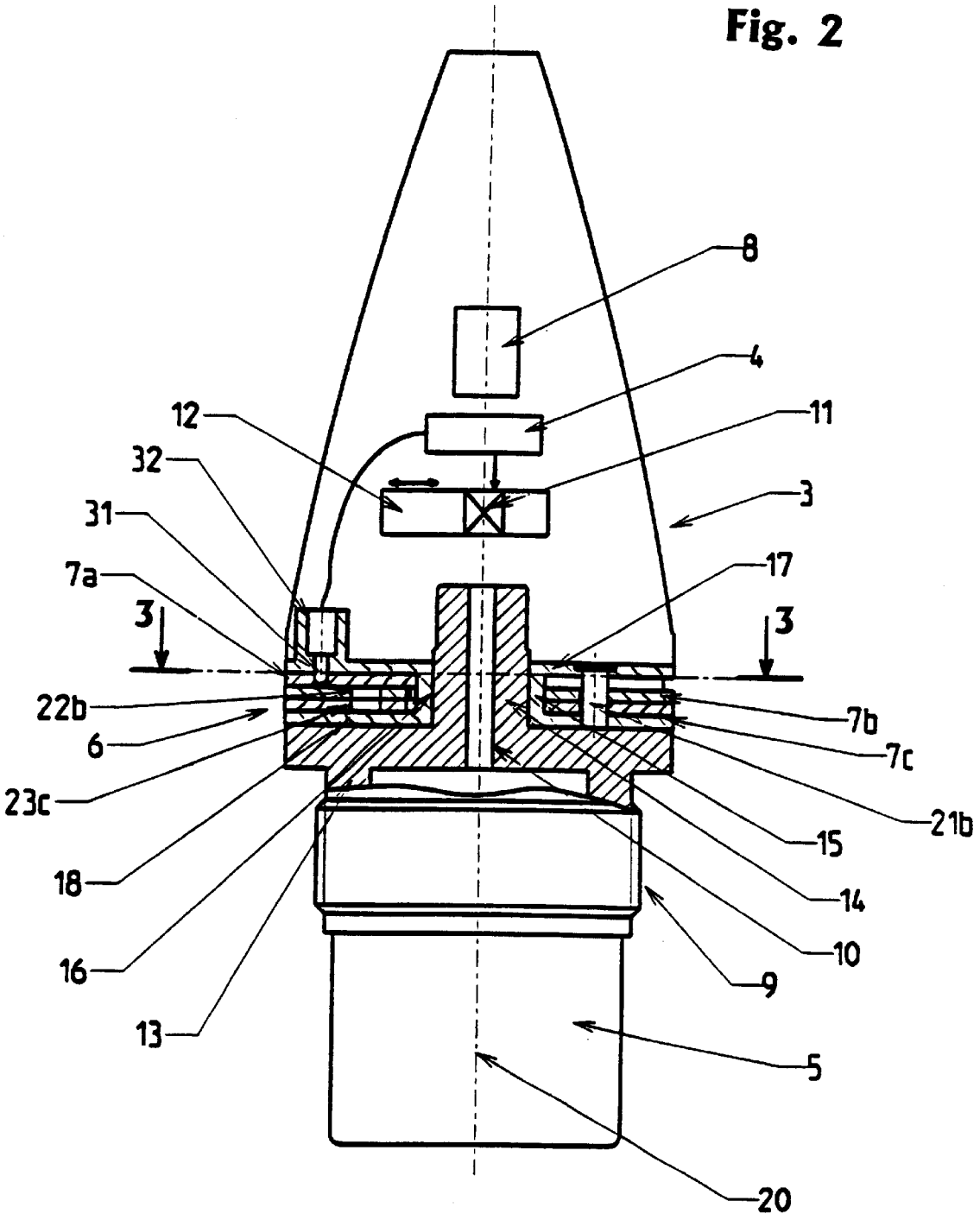
FIG. 2 is a partial lengthwise section of a projectile fuze equipped with a braking device according to a first embodiment of the invention.

FIG. 2 shows a more detailed view of the fuze. It has a general shape and size similar to that of conventional artillery fuzes. It has a body 13 having threaded section 9 so that it may be made integral with the projectile. Pyrotechnic charge 5 is placed in a cup integral with the body 13 and it communicates through a priming duct 10 with an electrically triggered initiation component 11 (primer or igniter), which, in turn, is connected to electronic control device 4.

In a conventional manner not described or shown in detail, initiation component 11 is borne by a mobile flap 12 of a safety and arming device.

Body 13 of the fuze has an axial cylinder 14 that links a lower portion of the fuze comprising the pyrotechnic charge 5 and an upper portion of the fuze enclosing the electronic device 4. Priming duct 10 runs through the cylinder 14. Cylinder 14 receives braking device 6, which comprises an axial support 15 of flaps, having a tubular part 16 and two plates 17, 18. Tubular part 16 is mounted coaxially with respect to cylinder 14 and thus has an inside diameter that is equal to that of cylinder 14. Upper plate 17 and lower plate 18 are planar and perpendicular to axis 20 of the fuze 3 and of the projectile. The two plates 17, 18 limit a ring-shaped volume inside which flaps 7*a*–7*c* are disposed. Support 15 is made integral with respect to translation and rotation of the body of the fuze 3, for example, by means of a locking screw mounted on cylinder 14, not shown.

According to the first embodiment of the invention, which is also the preferred embodiment, the three flaps 7*a*, 7*b* and 7*c* are integral with support 15.

Each flap can be moved in a plane perpendicular to axis 20 of the projectile. In its translation movement, it is guided by two cylindrical rods 21 (only one rod 21*b* is visible here); the rods are fixed, disposed between the two plates 17 and 18 and parallel to axis 20 of the projectile.

Figure 3:
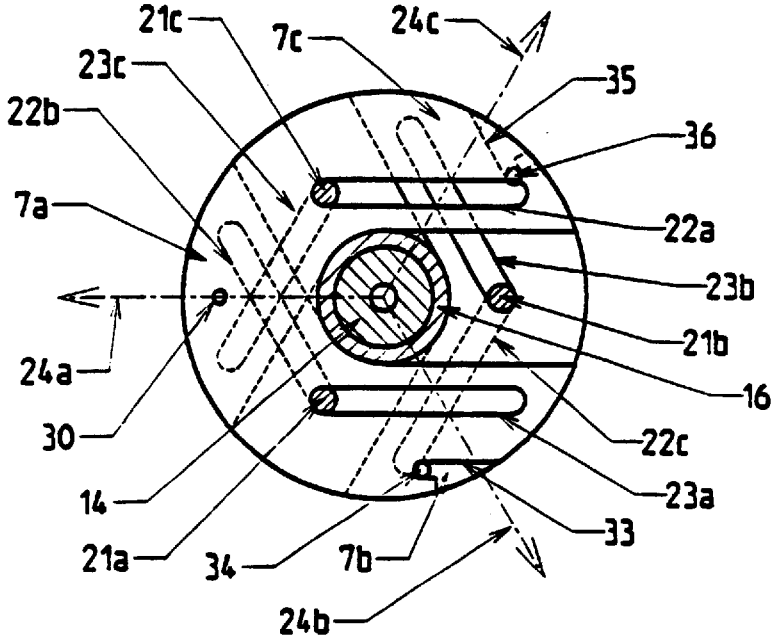
FIG. 3 shows the same device in the folded position with a cross section along a plane 3—3 in FIG. 2.

FIG. 3 shows the distribution of rods 21. The three rods 21*a*, 21*b*, 21*c* are provided and distributed in an angular manner and regularly around axis 20 of the fuze (at an equal distance from axis 20 and with an angle of 120° between each position). Each rod 21 is cylindrical and cooperates with two coaxial holes, one on upper plate 17 and the other one on lower plate 18. The rod has a flange for centering on a countersunk area of the upper plate and it has a diameter that is slightly greater than that of the holes in the plates to ensure its locking.

Each flap 7*a*, 7*b*, 7*c* has two closed grooves 22, 23, parallel to a direction 24 that is perpendicular to the axis 20 of the projectile. Upper flap 7*a* thus has two grooves 22*a*, 23*a*, extending parallel to a direction 24*a*. Middle flap 7*b* has two grooves 22*b*, 23*b*, extending parallel to a direction 24*b*. Lower flap 7*c* has two grooves 22*c*, 23*c*, extending parallel to a direction 24*c*.

The three directions 24*a*, 24*b* and 24*c* intersect axis 20 of the fuze; they are perpendicular to the axis 20 and between them form angles of 120°. Each groove 22, 23 cooperates with a rod 21 that is fixed with respect to the projectile and, more particularly, each rod 21 cooperates with two grooves 22, 23 of two adjacent flaps 4. Thus, rod 21 a provides for the guidance of groove 23*a* of flap 7*a* and of groove 22*b* of flap 7*b*. Rod 21*b* provides for the guidance of groove 23*b* of flap 7*b* and of groove 22*c* of flap 7*c*. Finally, 21*c* provides for the guidance of groove 23*c* of flap 7*c* and of groove 22*a* of flap 7*a*.

The various flaps are stacked on one another when they are in their folded position as shown in FIGS. 2 and 3. The first flap 7*a* or the upper flap is in contact with the upper plate 17; the third flap 7*c* (or the lower flap) is in contact with the lower plate 18.

The second flap 7*b* (or intermediate flap) is disposed between the first flap 7*a* and the third flap 7*c*. This type of flap arrangement ensures their mechanical hold in response to the acceleration developed during projectile firing.

Figure 4:
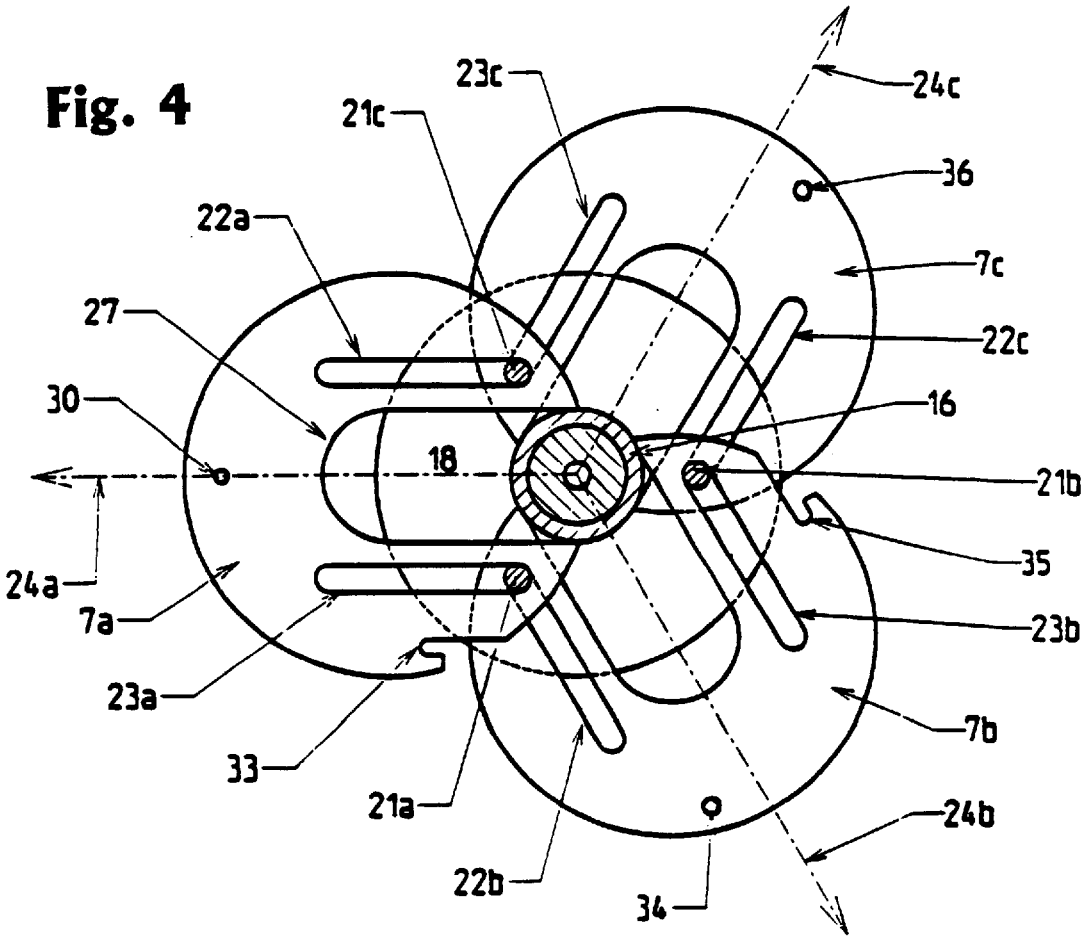
FIG. 4 is similar to FIG. 3, but it shows the device in the deployed position.

A clearance of approximately one-tenth of a millimeter is provided between rods 21*a*, 21*b* and 21*c* and the grooves to allow the flaps to shift from their storage position, as shown in FIG. 3, to their deployed position shown in FIG. 4.

The flaps can be seen in greater detail in FIGS. 5*a* to 5*f*. Each flap is made, for example, of steel plate 2 mm thick and has two grooves 22, 23, designed to receive rods 21. The flaps could also be made of some other material, for example a light (aluminum-based) alloy.

Each flap has an outside structural shape 25 that covers an arc of a circle whose diameter is essentially equal to the outside diameter of fuze 3. Each flap 7 also has a notch 26, designed to position the flap 7 around the tubular portion 16 of axial support 15. To this end, notch 26 has a semi-cylindrical portion 27 that has the same diameter as the diameter of the tubular portion 16 and is coaxial with axis 20 of the latter (in other words, also with respect to the axis of the fuze 3 and of the projectile). The semi-cylindrical portion 27 of the groove is connected to two plane surfaces 28, 29, which are parallel to grooves 22, 23.

This flap shape makes it possible to have a maximum flap surface for minimum bulk when in the folded position.

The flaps 7, furthermore, display several structural differences between each other. Thus, the first flap 7*a* has a hole 30, which is designed to receive rod 31 of a pyrotechnic piston 32 (see FIG. 2).

Here, the pyrotechnic piston 32 is a pyrotechnic retractor; it comprises a gas-generating compound that is initiated electrically by the control device 4 and which causes rod 31 to be extracted from hole 30. The pyrotechnic component is well known to the individual skilled in the art and will not be described in any further detail here.

Rod 31 of the retractor locks the first flap 7*a* into the folded position. First flap 7*a* also has a first notch 33, which is designed to cooperate with a first pin 34 that is borne by the second flap 7*b* to keep the latter in the folded position. The second flap 7*b* has a second notch 35 designed to cooperate with a second pin 36 borne by the third flap 7*c* to keep the latter in the folded position.

A single pyrotechnic piston 32 thus locks all three of the flaps 7 and prevents their deployment as a result of the centrifugal forces applied to them during projectile firing.

Figure 5A:
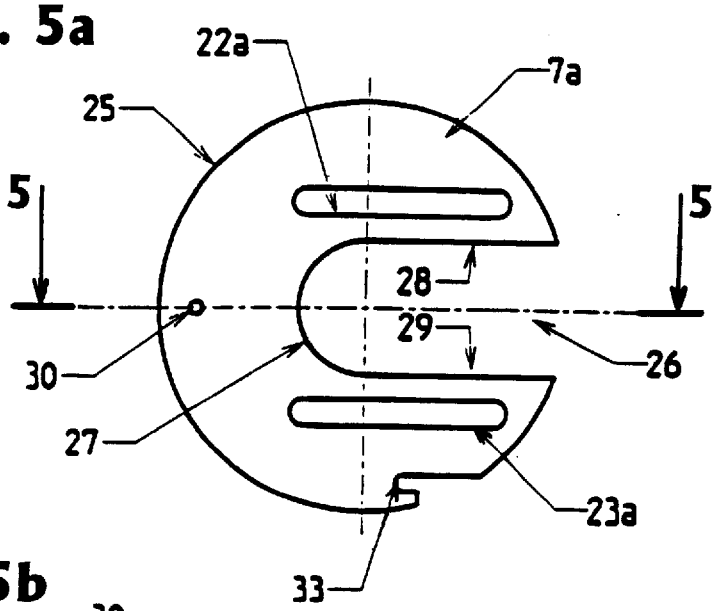
FIGS. 5*a* to 5*f* show the braking flaps alone.
Figure 5B:
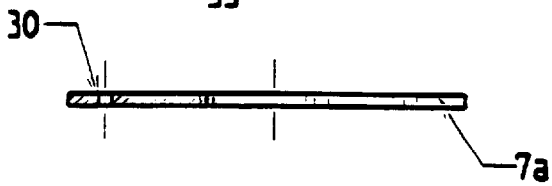
Figure 5D:
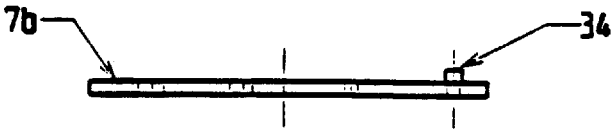
Figure 5C:
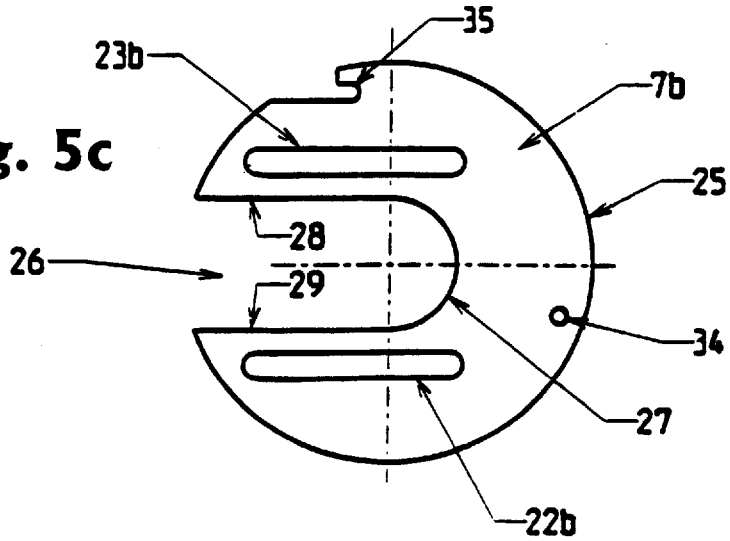
Figure 5F:
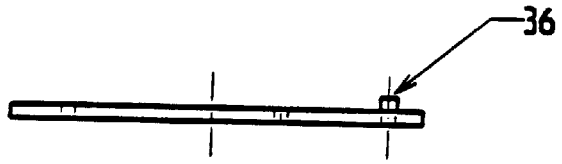
Figure 5E:
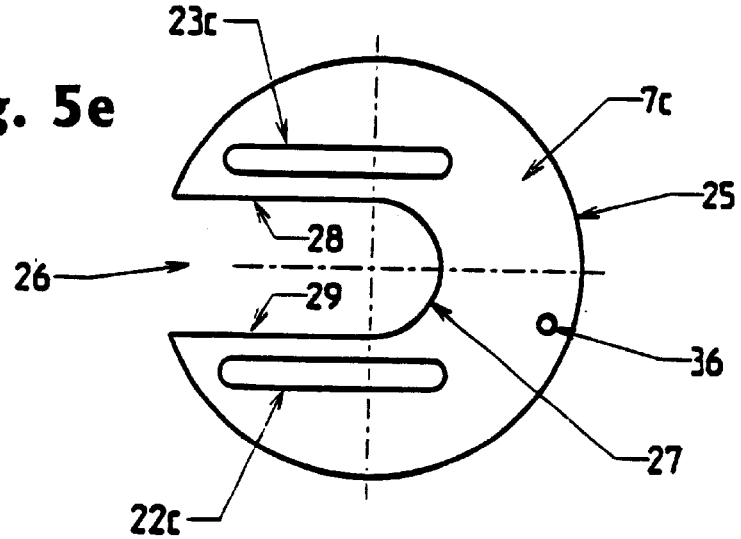

Pins 34, 36 consist of small cylindrical rods mounted in holes made on the flaps (see FIG. 5*f*).

FIG. 3 shows the three flaps in their folded and locked position.

The fuze was cut, in the figure, so as to withdraw the upper plate 17. Only the first flap 7*a* is completely visible. The three rods 21*a*, 21*b*, 21*c* are cut. The second flap 7*b* is partially visible in the notch 26 of the first flap. The third flap 7*c* is hidden. This figure shows how the various retaining means cooperate with each other to ensure the locking of the three flaps 7.

It will thus be understood that that when the first flap 7*a* is immobilized by rod 31 of the pyrotechnic piston inserted in hole 30, pin 34 of the second flap is positioned in notch 33 of the first flap 7*a*. The second flap 7*b* thus cannot be deployed. Pin 36, borne by the third flap 7*c*, is positioned in notch 35 of the second flap 7*b*. The third flap 7*c* thus cannot open.

At a given instant on the trajectory, electronic control device 4 extracts rod 31 of the pyrotechnic piston outside hole 30. Due to the centrifugal force, the first flap 7*a* is opened, moving along direction 24*a*. Notch 33 then releases pin 34, which, in turn, releases the second flap 7*b*, which can now also be opened. Notch 35 then releases pin 36, which releases the third flap 7*c* that can, in turn, now be opened.

Because only a single locking device is used (the pyrotechnic piston 32), the three flaps 7 open practically simultaneously. This results in symmetry and reproducibility of the opening, which prevents any disturbances on the braking trajectory of the projectile.

The opening movement is guided both by grooves 22, 23 and by the contact of the plane surfaces 28, 29 of each flap 7 with the tubular portion 16 of axial support 15. Any tilting or jamming that would be caused by the fact that each flap 7 is made to rotate partially around rods 21 due to the action of the centrifugal force is thus prevented.

FIG. 4 shows the flaps 7 in their deployed position.

The deployment of each flap 7 is stopped by the abutting of the various grooves 22, 23 on their respective rods 21. Rod 21 a thus constitutes a stop for grooves 23*a*, 22*b*, rod 21*b* constitutes a stop for grooves 23*b*, 22*c* and rod 21*c* constitutes a stop for grooves 23*c*, 22*a*.

This arrangement makes it possible to control the degree of radial opening of the flaps.

With the configuration according to the invention, when the flaps 7 are in the deployed position, the ends of each flap 7, which are situated on either side of notch 26, rest on a neighboring flap or on the lower plate 18 (which constitutes a support surface integral with the fuze 3, hence, with the projectile, and perpendicular to the axis 20 of the latter).

The rigidity of the support is thus increased. Moreover, when in the deployed position, plane surfaces 28, 29 of each flap 7 are still in contact with the tubular portion 16 of axial support 15.

By thus reducing the amplitude of opening of the flap 7 while ensuring that the latter are retained both axially by the lower plate and radially by the tubular portion 16, the rigidity of the braking device in the deployed position, and hence, its mechanical resistance to bending, can be improved.

Opening diameter D, thus obtained, is approximately 118 mm for an initial diameter of the lower plate amounting to approximately 61 mm, in other words, an increase in the diameter of approximately 93%. Thus, the device according to the invention makes it possible to have a large and rigid braking surface with reduced bulk and strong mechanical hold.

A number of variants are possible without going beyond the context of the invention. It is thus possible to vary the number of flaps 7.

Figure 6:
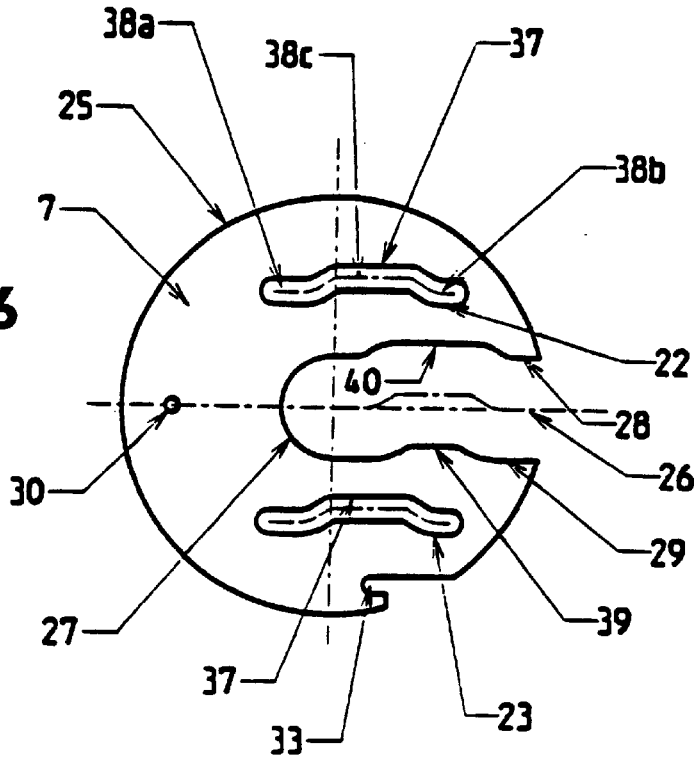
FIG. 6 shows a variant of the grooves of a braking flap.

FIG. 6 shows an alternative embodiment of a braking flap 7. This flap corresponds to the first flap 7*a*; it is thus provided with a hole 30 to receive the rod of the pyrotechnic retractor and a notch 33 to immobilize a second flap.

It differs from the previously described flaps in that each groove 22 and 23 has an indentation 37. The indentation 37 thus divides each groove into two rectilinearly aligned portions 38*a*, 38*b*, separated by another rectilinear portion 38*c* that is parallel to the former. The amplitude of the indentation is approximately 2 mm and its length is approximately 4 mm.

Further, an indentation 39 is made at plane surface 29 and an additional recess 40 is provided at plane surface 28. These arrangements permit the lateral translation of flap 7 with respect to cylindrical support 15 as rods 21 pass indentations 37.

This design makes it possible to brake the opening movement of flap 7. This is because, when rod 21 reaches the level of indentation 37, the clearance between the groove and the rod is distributed differently; the flap moves laterally with respect to support 16, the groove rubs against the rod, thus consuming energy and reducing the speed of the flap. The indentations thus constitute a means for slowing down the deployment movement of the flap. The shock associated with the abutting of each flap against the guide rods at the end of the deployment movement can thus be reduced, which increases the reliability of the device. It is possible to give the various indentations different forms: sinusoidal shapes, milling, special surface treatments, variation in the width of the grooves, etc.

The invention, of course, is understood to apply to all types of large-caliber (in excess of 50 mm) or medium-caliber (less than or equal to 50 mm) projectiles.

What is claimed is:

1. A device for translational braking of a projectile on its trajectory, comprising:

at least two radially deployable air brakes to increase the aerodynamic drag of the projectile; and the air brakes made in the shape of flaps that move in a plane perpendicular to the axis of the projectile, wherein each flap has at least two closed grooves that extend essentially parallel to a direction perpendicular to the projectile axis, each groove cooperating with a rod that is fixed with respect to the projectile.

2. The device according to claim 1, wherein each rod cooperates with a groove in each flap of two adjacent flaps.

3. The device according to claim 2, further comprising least one pyrotechnic piston that locks at least one of the flaps in the folded position.

4. The device according to claim 3, wherein at least two flaps are stacked on top of each other when they are in their folded position, at least a first of the two flaps comprising means to retain the second of the two flaps in the folded position.

5. The device according to claim 4, further comprising three flaps, a first flap being locked by the pyrotechnic piston, and having a first notch cooperating with a first pin borne by a second flap to keep the latter in the folded position, the second flap having a second notch, cooperating with a second pin borne by a third flap to keep the latter in the folded position, a single pyrotechnic piston thus locking all of the three flaps.

6. The braking device according to claim 1, wherein each flap has an external structural shape covering an arc of a circle whose diameter is essentially equal to that of an external portion of the projectile, and an indentation designed to position the flap in the folded position around an axial support integral with the projectile.

7. The braking device according to claim 3, wherein each flap has an external structural shape covering an arc of a circle whose diameter is essentially equal to that of an external portion of the projectile, and an indentation designed to position the flap in the folded position around an axial support integral with the projectile.

8. The braking device according to claim 5, wherein each flap has an external structural shape covering an arc of a circle whose diameter is essentially equal to that of an external portion of the projectile, and an indentation designed to position the flap in the folded position around an axial support integral with the projectile.

9. The device according to claim 6, wherein the axial support has two plates, a lower plate and an upper plate connected by the rods, the flaps being disposed between the two plates when they are in the folded position.

10. The device according to claim 7, wherein the axial support has two plates, a lower plate and an upper plate connected by the rods, the flaps being disposed between the two plates when they are in the folded position.

11. The device according to claim 8, wherein the axial support has two plates, a lower plate and an upper plate connected by the rods, the flaps being disposed between the two plates when they are in the folded position.

12. The device according to claim 6, wherein at least one groove of each flap has means allowing the deployment movement of the flap to be slowed down.

13. The device according to claim 9, wherein at least one groove of each flap has means allowing the deployment movement of the flap to be slowed down.

14. The device according to claim 12, wherein the means that make it possible to slow the deployment movement down comprise a particular shape of the groove and/or a particular shape of the notch, the groove and/or the notch having at least one indentation.

15. The device according to claim 13, wherein the means that make it possible to slow the deployment movement down comprise a particular shape of the groove and/or a particular shape of the notch, the groove and/or the notch having at least one indentation.

16. The device according to claim 1, wherein the flaps are integrated with a nose fuze of the projectile.

17. The device according to claim 12, wherein the flaps are integrated with a nose fuse of the projectile.

18. The device according to claim 13, wherein the flaps are integrated with a nose fuze of the projectile.

19. A device for braking a projectile in flight, comprising:

an axial part having an annular shape and mounted around an axial cylinder of a fuze body, the axial part having a first annular plate and a second annular plate extending perpendicular to an axis of the projectile;

a plurality of flaps mounted between the first annular plate and the second annular plate;

means for guiding deployment of the plurality of flaps;

means for retaining the plurality of flaps in a stowed position wherein an outer dimension of the plurality of flaps is substantially equal to an outer dimension of the fuze; and an electronic control device for activating the means for retaining such that the plurality of flaps deploy outwardly.

20. The device according to claim 19, wherein the means for retaining comprises a pyrotechnique piston with an attached rod, a flap of the plurality flaps having hole that receives the rod.

* * * * *